US012781631B2

(12) United States Patent
Zeng et al.

(10) Patent No.: US 12,781,631 B2
(45) Date of Patent: Nov. 3, 2026

(54) POST-MINING WATER-RESISTING LAYER RECONSTRUCTION METHOD AND RELATED DEVICE

(71) Applicant: CHINA UNIVERSITY OF MINING AND TECHNOLOGY, BEIJING, Beijing (CN)

(72) Inventors: Yifan Zeng, Beijing (CN); Weihong Yang, Beijing (CN); Jun Zhu, Beijing (CN); Qiang Wu, Beijing (CN); Kai Pang, Beijing (CN); Xinjiang Wei, Beijing (CN); Xuan Xiao, Beijing (CN); Xue Liu, Beijing (CN)

(73) Assignee: CHINA UNIVERSITY OF MINING AND TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 19/399,452

(22) Filed: Nov. 24, 2025

(65) Prior Publication Data

US 2026/0210248 A1 Jul. 23, 2026

(30) Foreign Application Priority Data

Jan. 22, 2025 (CN) ..... 202510100723.7

(51) Int. Cl.
*E21D 11/10* (2006.01)
*E21C 41/18* (2006.01)
*E21D 11/38* (2006.01)

(52) U.S. Cl.
CPC ..... *E21D 11/105* (2013.01); *E21C 41/18* (2013.01); *E21D 11/38* (2013.01)

(58) Field of Classification Search
CPC ..... E21D 11/105; E21D 11/38; E21C 14/18
See application file for complete search history.

(56) References Cited

U.S. PATENT DOCUMENTS 11,781,429 B1 * 10/2023 Zeng ..... E21B 33/13 299/11

FOREIGN PATENT DOCUMENTS

CN 114658485 A * 6/2022 ..... E21D 11/38
CN 117072202 A 11/2023

(Continued)

OTHER PUBLICATIONS

First Office Action issued in counterpart Chinese Patent Application No. 202510100723.7, dated Aug. 23, 2025.

(Continued)

*Primary Examiner* — Amber R Anderson
*Assistant Examiner* — Stacy N Lawson
(74) *Attorney, Agent, or Firm* — Westbridge IP LLC

(57) ABSTRACT

In a post-mining water-resisting layer reconstruction method through partition grouting for a coal-measure aquifer in coal seam roof strata, a precise analysis of hydrogeological characteristics of overlying strata may be achieved by comprehensively considering geological parameters and strata distribution parameters of a target mining area. Subsequently, a development height of a water-conducting fracture zone may be determined by utilizing distribution feature algorithms and numerical simulation algorithms. Further, an analysis of a correlation between the water-conducting fracture zone and the hydrogeological characteristics may be conducted through a distribution relationship algorithm. In this method, by implementing a target grouting control strategy based on distribution relationships for post-mining coal seam roof strata, the precision of water hazard control may be significantly enhanced. Further, a related post-mining water-resisting layer reconstruction device is also disclosed.

6 Claims, 5 Drawing Sheets

(56) References Cited

FOREIGN PATENT DOCUMENTS

| | | | | | |
|---|---|---|---|---|---|
| CN | 119086870 | A | | 12/2024 | |
| CN | 121024600 | A | * | 11/2025 | F42D 3/04 |

OTHER PUBLICATIONS

Liu et al., A SMOGN-based MPSO-BP model to predict the height of a hydraulically conductive fracture zone, Coal Geology & Exploration, vol. 52, No. 11, pp. 101-104, dated Oct. 31, 2024.
Lv et al., Research status and development trend of water-flowing fractured zone, Coal Mine Modernization, No. 2, pp. 101-104, dated Apr. 15, 2013.
Zhang et al., Coal seam roof and floor hydrogeology conditions evaluation of Pingshuo No. 1 mine and measures of preventing water bursting, Strategic Study of CAE, No. 11, pp. 94-101, dated Nov. 15, 2011.
Zheng et al., Prediction of Roof Water Inrush Based on Multivariate Integrated Analysis Model, Chinese Journal of Management Science, vol. 33 No. 7, pp. 187-199, dated Jul. 31, 2025.

* cited by examiner

POST-MINING WATER-RESISTING LAYER RECONSTRUCTION METHOD AND RELATED DEVICE

CROSS-REFERENCE TO RELATED APPLICATIONS

This application claims priority to Chinese Patent Application No. 202510100723.7, filed on Jan. 22, 2025, the content of which is incorporated herein by reference in its entirety.

TECHNICAL FIELD

This application relates to the field of coal mine water hazard control technology, and more particularly to a post-mining water-resisting layer reconstruction method and device through partition grouting for a coal-measure aquifer in coal seam roof strata.

BACKGROUND

Coal mining often faces challenges related to water resource protections and mine water hazards. During coal seam extractions, overlying aquicludes may undergo varying degrees of compressions, shears, and tensile damages due to additional stress, leading to changes in their water-blocking performance. The damages to the aquicludes allow water from overlying aquifers to seep into a goaf through the aquicludes, triggering water inrush accidents and exacerbating the loss of shallow water resources, which may cause regional ecological and environmental damages ultimately. The destruction of the groundwater system and aquicludes by mining activities not only results in significant water resource losses and groundwater level declines but also substantially increases safety risks of productions and environmental issues.

In light of the above, existing technologies may use grouting to block water and reconstruct the aquicludes to implement mine water hazard controls and protections. However, these methods fail to account for varying geological conditions and lack of targeted approaches to water hazard managements.

SUMMARY

In view of the above, examples of the present disclosure provide a post-mining water-resisting layer reconstruction method and device through partition grouting for a coal-measure aquifer in coal seam roof strata to address problems of existing technologies.

Examples of the present disclosure provide a post-mining water-resisting layer reconstruction method through partition grouting for a coal-measure aquifer in coal seam roof strata, which includes:

obtaining geological parameters of a target mining area;

determining strata distribution parameters of the target mining area based on the geological parameters;

performing a feature analysis processing on the strata distribution parameters through a distribution feature algorithm to determine hydrogeological characteristics of coal seam roof strata in the target mining area;

performing a water-conducting fracture zone analysis on the hydrogeological characteristics through a numerical simulation algorithm to determine a development height of a water-conducting fracture zone; performing a distribution relationship analysis on the development height of the water-conducting fracture zone and the hydrogeological characteristics through a distribution relationship algorithm to obtain a distribution relationship between the development height of the water-conducting fracture zone and the hydrogeological characteristics and determining a target grouting control strategy for post-mining coal seam roof strata based on the distribution relationship; implementing a grouting treatment on the post-mining coal seam roof strata according to the target grouting control strategy;

where, the hydrogeological characteristics comprises:

a position of a weathered bedrock, a positions of a loose aquifer, and/or a position of one or more abnormal water-rich zones;

performing a distribution relationship analysis on the development height of the water-conducting fracture zone and the hydrogeological characteristics through a distribution relationship algorithm to obtain a distribution relationship between the development height of the water-conducting fracture zone and the hydrogeological characteristics and determining a target grouting control strategy for post-mining coal seam roof strata based on the distribution relationship comprises: determining the distribution relationship based on the development height of the water-conducting fracture zone and the position of the weathered bedrock;

in response to determining the distribution relationship indicating that the development height of the water-conducting fracture zone does not extend into the weathered bedrock, determining a first determination result about whether there exists an abnormal water-rich zone within the development height of the water-conducting fracture zone;

in response to determining the first determination result is negative, determining the target grouting control strategy for the post-mining coal seam roof strata as no grouting treatment required;

in response to determining the first determination result is affirmative, determining the target grouting control strategy for the post-mining coal seam roof strata as performing a curve branch borehole drilling and grouting in each aquiclude beneath each abnormal water-rich zone within an aquifer within the development height of the water-conducting fracture zone; the method further includes the following steps after determining the distribution relationship based on the development height of the water-conducting fracture zone and the position of the weathered bedrock:

in response to determining the distribution relationship indicating that the development height of the water-conducting fracture zone extends into the weathered bedrock, determining a second determination result about whether the development height of the water-conducting fracture zone reaches the position of the loose aquifer;

in response to determining the second determination result is negative, determining a third determination result about whether the loose aquifer migrates to recharge the weathered bedrock;

in response to determining the third determination result is affirmative, determining a fourth determination result whether there exists an abnormal water-rich zone within the development height of the water-conducting fracture zone;

in response to determining the fourth determination result is affirmative, determining the target grouting control strategy for the post-mining coal seam roof strata as grouting at the position of the weathered bedrock and implementing a curve branch borehole drilling and grouting in each aquiclude beneath each abnormal water-rich zone in an aquifer within the development height of the water-conducting fracture zone;

in response to determining the fourth determination result is negative, determining the target grouting control strategy for the post-mining coal seam roof strata as grouting at the position of the weathered bedrock, grouting and repairing the aquiclude within the development height of the water-conducting fracture zone to reconstruct the aquicludes;

the method further comprises the following steps after determining the second determination result is negative and determining the third determination result about whether the loose aquifer migrates to recharge the weathered bedrock:

in response to determining the third determination result is negative, determining a fifth determination result about whether there exists an abnormal water-rich zone within the development height of the water-conducting fracture zone;

in response to determining the fifth determination result is affirmative, determining the target grouting control strategy for the post-mining coal seam roof strata as implementing a curve branch borehole drilling and grouting in each aquicludes beneath each abnormal water-rich zone in an aquifer within the development height of the water-conducting fracture zone; and in response to determining the fifth determination result is negative, determining the target grouting control strategy for the post-mining coal seam roof strata as grouting and repairing the aquiclude within the development height of the water-conducting fracture zone to reconstruct the aquiclude.

Based on the same inventive concept, the present disclosure further provides an electronic device comprising a memory, a processor, and a computer program stored on the memory and executable by the processor, wherein the processor executes the computer program to implement the method described above.

As described above, the post-mining water-resisting layer reconstruction method and device through partition grouting for a coal-measure aquifer in coal seam roof strata provided by the present disclosure may address the issues of water hazards in post-mining coal seam roof strata of the coal seam. By comprehensively considering the geological parameters and the strata distribution parameters of the target mining area, a precise analysis of the hydrogeological characteristics of the coal seam roof strata may be achieved. Subsequently, through a distribution feature algorithm and a numerical simulation algorithm, the development height of the water-conducting fracture zone may be determined accurately. Further, through a distribution relationship algorithm, a correlation between the water-conducting fracture zone and hydrogeological characteristics may be analyzed. It can be seen that this approach may fully account for differences in various geological conditions. Therefore, a target grouting control strategy for the post-mining coal seam roof strata may be determined based on the distribution relationship. In this way, grouting treatments may be implemented to enhance the precision of water hazard control significantly. In this way, issues of ineffective grouting treatments caused by complex geological conditions may be avoided, and risks of water hazards in the coal seam roof strata may be reduced effectively.

BRIEF DESCRIPTION OF THE DRAWINGS

To illustrate technical solutions of the present disclosure or the prior art more clearly, drawings used in examples or the prior art will be briefly introduced. Obviously, the drawings in the following description are only some examples of the present disclosure. For those of ordinary skill in the art, other drawings may be obtained based on these drawings without creative effort.

DETAILED DESCRIPTION OF THE EMBODIMENTS

Figure 1:
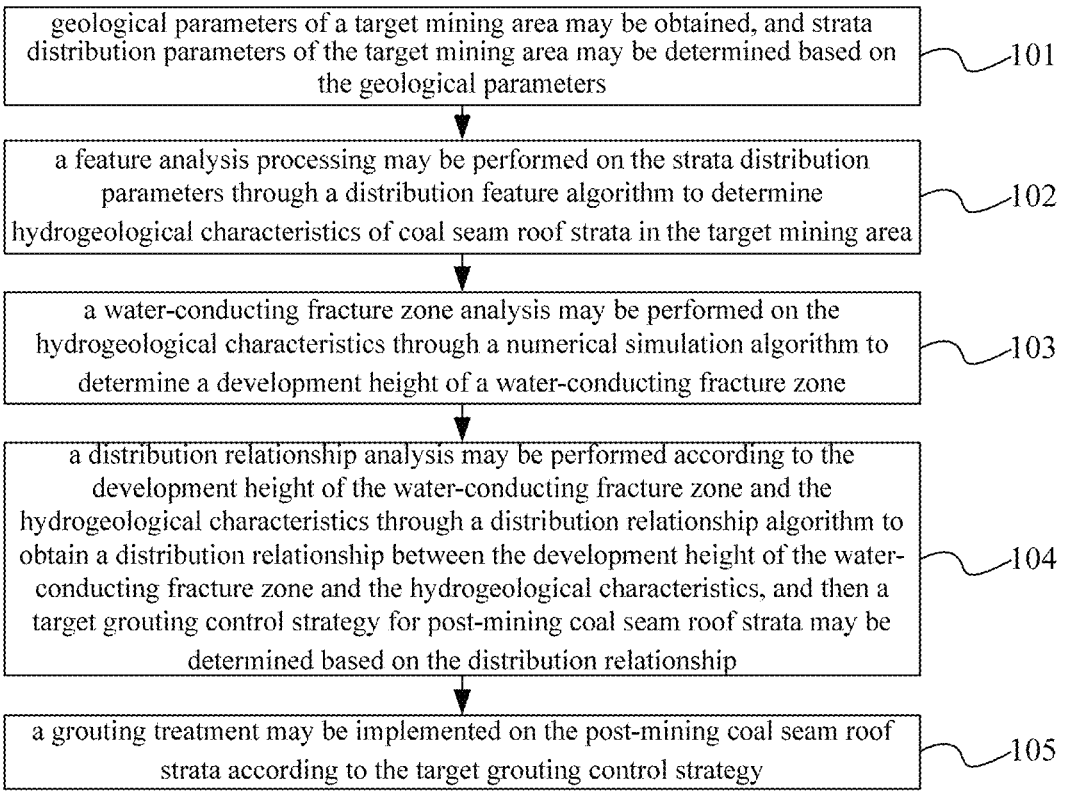
FIG. 1 is a flowchart of a post-mining water-resisting layer reconstruction method through partition grouting for a coal-measure aquifer in coal seam roof strata according to examples of the present disclosure.

To make the objectives, technical solutions, and advantages of the present disclosure clearer, the following further describes the present disclosure in detail with reference to specific examples and accompanying drawings.

It should be noted that, unless otherwise defined, technical terms or scientific terms used in the examples of the present disclosure shall have the ordinary meanings understood by persons skilled in the art. The terms "first", "second", and similar terms used in the examples of the present disclosure do not denote any order, quantity, or importance, but are merely used to distinguish different components. The terms "comprising" or "including" and similar terms mean that elements or items preceding the term encompass elements or items listed after the term and their equivalents, but do not exclude other elements or items. The terms "connected" or "coupled" and similar terms are not limited to physical or mechanical connections, but may include electrical connections, whether direct or indirect. Terms such as "upper", "lower", "left", and "right" are used only to indicate relative positional relationships. When the absolute position of the described object changes, the relative positional relationship may also change accordingly.

Coal mining often faces challenges related to water resource protections and mine water hazards, particularly in arid and semi-arid regions where ecological environment is fragile and water resources are scarce.

During coal seam extractions, overlying aquicludes may undergo varying degrees of compressions, shears, and tensile damages due to additional stress, leading to changes in their water-blocking performances. The damages to the aquicludes allow water from the overlying aquifers to seep into a goaf through the aquicludes, triggering water inrush accidents and exacerbating losses of shallow water resources, ultimately causing regional ecological and environmental damages. The destruction of groundwater systems and aquicludes by mining activities not only results in significant water resource losses and groundwater level declines but also substantially increases production safety risks and environmental issues.

To address the aforementioned issues, current primary approaches for mine water hazard controls and protections involves grouting and water-blocking technologies. In recent years, related technologies have conducted researched on the mining-induced issues of aquicludes from various fields and at different levels, achieving a series of significant results. In the management and protection of roof water, various methods of aquicludes reconstruction have been proposed.

For example, an exploration and evaluation method for aquiclude reconstructions can assess whether the water-blocking performance of an aquiclude (a rock-soil layer), which has been damaged by mining, can recover relatively quickly under natural conditions over time.

In a multi-stage graded grouting method for reconstructing mining-induced overburden aquicludes, by implementing a three-stage grouting at multiple grouting targets, sealings of fractures at different scales may be achieved across multiple targets, therefore the mining-induced overburden aquicludes can be reconstructed.

A water-retaining and rock burst prevention coal mining method based on pressure-relief fracture grouting for reconstructing anti-rock burst aquicludes may involve pre-splitting thick, hard sandstone layer above the coal seam before mining, transforming the original thick, hard sandstone layer above the coal seam into an anti-rock burst aquiclude.

While the above-mentioned methods all involve aquiclude reconstructions, they fail to distinguish relationships among different bedrock conditions, regional distribution characteristics of water-richness of the aquifer, caving zones, and the development height of water-conducting fractures. Consequently, the water hazard control plans lack specificity.

Therefore, how to implement grouting treatment effectively for different types of roof water, considering varying bedrock conditions, regional distribution characteristics of water-richness of the aquifer, fracture zones, and the development height of water-conducting fractures, is a critical issue related to mine production safety and the protection of regional ecological environments.

The present application provides a post-mining water-resisting layer reconstruction method through partition grouting for a coal-measure aquifer in coal seam roof strata and related devices to address water hazards in the coal seam roof strata after mining. In the present application, a precise analysis of hydrogeological characteristics of overlying strata may be achieved by comprehensively considering geological parameters and strata distribution parameters of a target mining area. Subsequently, a development height of a water-conducting fracture zone may be determined by utilizing a distribution feature algorithm and a numerical simulation algorithm. Further, an in-depth analysis of a correlation between the water-conducting fracture zone and the hydrogeological characteristics may be conducted through a distribution relationship algorithm. In this method, differences in various geological conditions may be fully considered. In this way, by implementing a target grouting control strategy based on the distribution relationship for post-mining coal seam roof strata, the precision of the water hazard control may be significantly enhanced. This approach may avoid issues of ineffective grouting treatments due to complex geological conditions. Therefore, risks of water hazards in the coal seam roof strata may be reduced effectively.

As shown in FIG. 1, the method in the present disclosure may include the following steps.

In block 101, geological parameters of a target mining area may be obtained, and strata distribution parameters of the target mining area may be determined based on the geological parameters.

In this block, the geological parameters for the target mining area may include but not limited to a lithology (rock type), a stratum thickness, a dip angle of a rock layer, a fault distribution, a fold morphology, a magmatic activity, and a mineralization type.

The geological parameters, such as mining area geological and hydrogeological data, may primarily involve collecting information from coal mine drilling, borehole cores, well-logging curves, a thickness of a coal seam, a rock hardness of a roof stratum, and spatial distribution characteristics and combination relationships of aquifers and aquicludes.

These parameters can be obtained through geophysical explorations (e.g., a seismic exploration, an electrical prospecting, a magnetic prospecting) or remote sensing technologies.

After acquiring the geological parameters of the target mining area, the next task is to infer and determine strata distribution parameters of the mining area based on these parameters.

The strata distribution parameters refer to data and information that describe a spatial distribution and arrangement characteristics of the strata, such as a stratigraphic sequence, stratigraphic positions, thickness variations, and spatial extension patterns.

Examples of the strata distribution parameters may include interfaces of a loose aquifer and a range of a weathered bedrock.

Through 3D geological modeling, the geological parameters can be converted into 3D models or 2D planar maps of the distribution of the strata, which may visually display the distribution characteristics of the strata within the mining area, thereby the strata distribution parameters of the target mining area may be determined.

In block 102, a feature analysis processing may be performed on the strata distribution parameters through a distribution feature algorithm to determine hydrogeological characteristics of coal seam roof strata in the target mining area.

In this block, the distribution feature algorithm may be used to extract valuable information from the strata distribution parameters, those are, the hydrogeological characteristics of the coal seam roof strata in the target mining area. This enables a deeper understanding of distribution patterns, interrelationships, and potential geological processes of the strata.

Hydrogeological characteristics may be used to describe distributions and movements of groundwater in the target mining area, as well as relationships with geological structures. These characteristics may typically involve permeabilities, water-bearing capacities, and groundwater flow conditions of the rock strata, which may be critical for evaluating mining conditions and preventing water hazards.

Hydrogeological features may include groundwater recharge sources, flow directions, flow velocities, water level fluctuations, and distributions of aquifers.

For example, by analyzing vertical distributions of aquifers and aquicludes in the coal seam roof strata and assessing water-richness of the aquifers, an algorithm can be used to identify specific vertical interbedding patterns of aquifers and aquicludes in the coal seam roof strata (i.e., hydrogeological characteristics) based on geological and hydrogeological data (i.e., the strata distribution parameters). This allows for precise determinations of locations of the aquifers and the aquicludes (i.e., the hydrogeological characteristics), identifications of water-rich zones in post-mining aquifers (i.e., the hydrogeological characteristics), and analysis of distribution patterns of water-rich zones (i.e., the hydrogeological characteristics).

In block 103, a water-conducting fracture zone analysis may be performed on the hydrogeological characteristics through a numerical simulation algorithm to determine a development height of a water-conducting fracture zone.

In this block, before conducting the analysis of the water-conducting fractured zone, it is essential to understand the hydrogeological characteristics of the target mining area comprehensively. The comprehensive understanding may include acquiring basic information such as a lithology, a thickness, a permeability, and a groundwater level of the strata, as well as a spatial distribution and geological structures of the strata.

Special attentions may also be given to the presence of geological structures (e.g., faults, joints) within the target mining area, as these features may influence the development of the water-conducting fractured zone.

Based on the hydrogeological characteristics of the target mining area and specific analytical requirements, an appropriate numerical simulation algorithm (e.g., FLAC3D, UDEC, RFPA, 3DEC, ANSYS, COMSOL) may be selected to simulate mechanical behaviors and deformation processes under actual engineering conditions.

Among them, FLAC3D may employ an explicit Lagrangian finite-difference method to simulate the mechanical behaviors and deformation processes of rock masses. RFPA may focus on analyzing rock fracture and may be suitable for modeling deformations and collapses of overlying strata after coal mining.

After selecting the appropriate numerical algorithm, a corresponding numerical model must be established. This involves creating a geotechnical-physical conceptual model that may incorporate mechanical properties and structural characteristics of the rock strata in the study area, as well as the stress and deformation boundaries.

To improve a computational accuracy, a mesh refinement may be applied to critical sections of the study area, and initial conditions and boundary conditions may be set according to real-world scenarios.

A numerical model may be established to analyze the water-conducting fractured zone. The analyze may include simulating the deformations and collapses of overlying strata after coal mining, as well as analyzing the developmental characteristics of the water-conducting fractured zone.

Through simulation, key parameters such as the development height and morphology of the water-conducting fractured zone (i.e., the height of the water-conducting fractured zone) may be determined.

For example, a combination of physical monitoring and numerical simulation may be employed. Field measurements may adopt one or more techniques, such as borehole flushing fluid method, microseismic detection, downhole upward borehole water injection leakage testing, or borehole television method. Numerical simulations of the fractured zone height can be conducted using one or more software (e.g., FLAC, UDEC, RFPA, 3DEC, ANSYS, COMSOL). By integrating these approaches, the heights of the caving zone and the water-conducting fractured zone (i.e., the height of the water-conducting fractured zone) may be comprehensively analyzed.

In block 104, a distribution relationship analysis may be performed according to the development height of the water-conducting fracture zone and the hydrogeological characteristics through a distribution relationship algorithm to obtain a distribution relationship between the development height of the water-conducting fracture zone and the hydrogeological characteristics, and then a target grouting control strategy for post-mining coal seam roof strata may be determined based on the distribution relationship.

In this block, the water-conducting fractured zone may refer to a fissure area with water-conducting capacity formed by movements and fracturing of overlying strata after the coal mining. These fractures may allow groundwater flows, posing a threat to a safe coal mine production. The development height refers to distributions and extensions of these water-conducting fractured zones in the space above the coal seam roof strata, including a size, a shape, an orientation, and a depth.

The distribution relationship algorithm may be used to analyze a correlation or an interaction between the development height of the water-conducting fractured zone and the hydrogeological characteristics to derive the distribution relationship. This distribution relationship reveals an intrinsic link between the development height of the water-conducting fractured zone and the hydrogeological characteristics.

Based on the above distribution relationship, a targeted grouting control strategy for the coal seam roof strata can be formulated.

Grouting control may be a coal mine water prevention and control technology that involves injecting grout (e.g., cement slurry, chemical grout) into fractures or aquifers in the coal seam roof strata to seal fractures, reduce water permeabilities, and enhance rock layer stabilities.

The target grouting control strategy may include selections of grouting points, choices of grouting materials, setting of grouting pressures, and monitoring of grouting processes.

By precisely analyzing the distribution relationship between the development height of the water-conducting fractured zone and the hydrogeological characteristics, a more effective target grouting control strategy for the coal seam roof strata can be developed, therefore a safe coal mine production may be ensured.

In block 105, a grouting treatment may be implemented on the post-mining coal seam roof strata according to the target grouting control strategy.

In this block, the precision of water hazard control may be enhanced significantly by implementing the target grouting control strategy on post-mining coal seam roof strata based on the distribution relationship established. This approach may avoid issues of suboptimal grouting efficacy caused by complex geological conditions. In this way, water-related risks in the coal seam roof strata may be mitigated effectively.

As described above, the post-mining water-resisting layer reconstruction method through partition grouting for a coal-measure aquifer in the coal seam roof strata provided by the present disclosure may address the issues of water hazards in the post-mining coal seam roof strata of the coal seam. By comprehensively considering the geological parameters and the strata distribution parameters of the target mining area, precise analysis of the hydrogeological characteristics of the coal seam roof strata may be achieved. Subsequently, through the distribution feature algorithm and the numerical simulation algorithm, the development height of the water-conducting fracture zone may be determined accurately. Further, through a distribution relationship algorithm, the correlation between the water-conducting fracture zone and the hydrogeological characteristics may be analyzed. It can be seen that this approach may fully account for the differences in various geological conditions. Therefore, a target grouting strategy for the post-mining coal seam roof strata may be determined based on the distribution relationship. In this way, grouting treatments may be implemented to enhances the precision of water hazard control significantly. In this way, the issues of ineffective grouting treatments caused by complex geological conditions may be avoided, and risks of water hazards in the coal seam roof strata may be reduced effectively.

In some examples of the present disclosure, in block 101, the step of determining the strata distribution parameters of the target mining area based on the geological parameters may include the following steps.

At first, a geological structure analysis of strata where the target mining area is located may be conducted based on the geological parameters to obtain a geological structure analysis result.

Then, a comparison result may be obtained by comparing the geological structure parameters of different predefined strata with the geological structure analysis result.

At last, the strata where the target mining area is located may be divided based on the comparison result to obtain the strata distribution parameters of the target mining area.

In the above schemes, the geological structure analysis may be performed on the strata of the target mining area based on the geological parameters collected. This analysis aims to understand the structure, the morphology, and the spatial relationships of the strata. In this way, the geological structure analysis result may be obtained. The result may reveal geological phenomena such as faults, folds, and uplifts within the strata.

Before conducting the comparison, a set of geological structure parameters may be predefined for different strata as references. These parameters may be determined based on known geological data or empirical data from similar regions.

The geological structure analysis result may then be compared with the predefined geological structure parameters of different strata to identify similarities and differences between the target mining area strata and known strata. By comparison, a comparison result may be yield.

Based on the comparison result, the strata in the target mining area can be classified according to their geological characteristics, structural types, or relative positions to other strata.

Ultimately, through the stratigraphic classification, the strata distribution parameters of the target mining area may be obtained. These parameters may include the thickness, the distribution range, the relative positions, and the contact relationships of various strata.

The geological parameters, such as mining area geological and hydrogeological data, may primarily include collected coal mine drilling data, borehole cores, well-logging curves, coal seam thickness, roof strata rock hardness, and the spatial distribution and combination characteristics of the aquifers and the aquicludes. Based on this, base interfaces of the loose aquifer and a range of the weathered bedrock (i.e., the strata distribution parameters) may be delineated, enabling a fine-scale stratigraphic classification.

In some examples of the present disclosure, block 102 may include the following steps.

First, a groundwater flow simulation may be conducted based on the strata distribution parameters to obtain a groundwater flow simulation result.

Then, the hydrogeological characteristics of the coal seam roof strata in the target mining area may be determined based on the groundwater flow simulation result.

In the above schemes, the strata distribution parameters may include but not limited to parameters such as a lithology, a thickness, a permeability, and a porosity of the strata. These parameters may serve as a foundation for subsequent groundwater flow simulations.

Based on the strata distribution parameters collected, simulations may be conducted through a groundwater flow model (e.g., a numerical model, an analytical model, or a physical model). These simulations aim to model groundwater flows within different strata, including flow velocities, directions, and discharges. The groundwater flow simulation result may reflect the dynamic characteristics of the groundwater system.

After obtaining the groundwater flow simulation result, a detailed analysis of the result may be required. The analysis may include identifying primary flow paths of the groundwater, determining water-bearing conditions of different strata, and assessing potential impacts of the groundwater on the coal seam roof strata.

Based on the analysis of the groundwater flow simulation result, the hydrogeological characteristics of the coal seam roof strata in the target mining area can be further determined. These characteristics may include the permeabilities of the rock strata, the distributions of the aquifers, and the recharge and discharge conditions of the groundwater. These characteristics are of significant importance for evaluating mining conditions, preventing water-related accidents, and formulating reasonable mining plans.

For example, the strata distribution parameters may refer to geological characteristics and hydrogeological characteristics of the mining area. The hydrogeological characteristics may include specific vertical interbedding distribution patterns of the aquifers and the aquicludes in the coal seam roof strata, the locations of the aquifers and the aquicludes, as well as the water-rich zones of the aquifers and distribution patterns of the water-rich zones.

The vertical distribution of the aquifers and the aquicludes in the coal seam roof strata, as well as the water-richness conditions of the aquifers, may be identified. By analyzing the geological and hydrogeological data of the mining area, the specific vertical interbedding distribution patterns of the aquifers and the aquicludes in the coal seam roof strata may be analyzed to determine the locations of the aquifers and the aquicludes precisely, identify the water-rich zones of the aquifers after mining, and analyze the distribution patterns of water-rich zones in the aquifers.

In some examples of the present disclosure, block 103 may include the following steps.

First, a geological feature simulation model of the strata in the target mining area may be constructed based on the hydrogeological characteristics.

Then, a stope of the strata may be simulated in the target mining area through the geological feature simulation model according to a predefined mining thickness threshold to obtain a height of the water-conducting fracture zone and/or a height of a caving zone of overlying strata.

Further, the height of the water-conducting fracture zone and/or the height of the caving zone of overlying strata may be taken as the development height of the water-conducting fracture zone.

In the above schemes, the hydrogeological characteristics may include distributions of groundwater, flow conditions, properties of the aquifers, a rock permeability, and groundwater recharge/discharge conditions.

Based on these hydrogeological characteristics, a simulation model (i.e., a geological feature simulation model) may be constructed to reflect true geological features of the strata in the target mining area (e.g., the stratigraphic structure, the rock properties, and the groundwater dynamics). Specifically, a geological modeling software or a tool can be used to create a 3D geological model (i.e., the geological feature simulation model) based on the hydrogeological characteristics. This 3D geological model will be used for subsequent simulations and analyses.

Before the simulation begins, a threshold of a mining thickness (i.e., the preset mining thickness threshold) may be set. This threshold may be determined based on factors such as safe extraction conditions and a geological stability of the mining area.

Using the geological feature simulation model previously constructed, a simulation of mining may be conducted according to the preset threshold of the mining thickness. This process simulates deformations and collapses of the overlying strata during the mining operation.

After the simulated stope, a series of deformation parameters of the overlying strata (e.g., a height of the water-conducting fractured zone, a displacement, a strain) and collapse parameters (e.g., a height of the caving zone) may be obtained.

These deformation parameters and the collapse parameters may be used to predict and evaluate the development height of the water-conducting fractured zone that may form during the mining process. The water-conducting fractured zone may be formed by the collapses and deformations of the overlying strata caused by mining, and it may affect groundwater flow and mine safety.

In addition, physical monitoring and numerical simulation methods can also be adopted. Specifically, one or more of the following field measurement techniques may also be employed: a borehole flushing fluid method, a microseismic detection, a downhole upward borehole water injection leakage testing, or a borehole television method. Simultaneously, one or more software (e.g., FLAC, UDEC, RFPA, 3DEC, ANSYS, COMSOL) may be used for a numerical simulation of the development height of the fractured zone. By integrating these approaches, the height of the caving zone and the height of the water-conducting fractured zone (i.e., the development height of the water-conducting fractured zone) may be comprehensively analyzed.

In some examples, the hydrogeological characteristics may further include a position of the weathered bedrock and/or a position of the loose aquifer and/or a position of one or more abnormal water-rich zones.

In some examples of the present disclosure, block 104 may include the following steps.

First, the distribution relationship may be determined based on the development height of the water-conducting fracture zone and the position of the weathered bedrock.

In response to determining the distribution relationship indicating that the development height of the water-conducting fracture zone does not extend into the weathered bedrock, a first determination result about whether there exists an abnormal water-rich zone within the development height of the water-conducting fracture zone may be determined.

In response to determining the first determination result is negative, the target grouting control strategy for the post-mining coal seam roof strata may be determined as no grouting treatment required.

In response to determining the first determination result is affirmative, the target grouting control strategy for the post-mining coal seam roof strata may be determined as performing a curve branch borehole drilling and grouting in each aquiclude beneath each abnormal water-rich zone within an aquifer within the development height of the water-conducting fracture zone.

In the above schemes, when the water-conducting fractured zone does not extend into the weathered bedrock, whether there is an abnormal water-rich zone within the water-conducting fractured zone may be determined. If there is no abnormal water-rich zone within the water-conducting fractured zone, the target grouting control strategy for the post-mining coal seam roof strata may be determined as no targeted treatment required.

Alternatively, if such an abnormal water-rich zone exists, the target grouting control strategy may be defined as follows: a curved branch borehole drilling and grouting may be performed beneath each aquiclude of each independent aquifer with high water-richness within the developmental height of the water-conducting fractured zone. This process may repair the rock layers damaged by the water-conducting fractured zone and creates a local aquiclude. Subsequently, the advancement direction of the branch borehole may be controlled to grout-connect the aquicludes repaired, integrating them into a unified, continuous aquiclude.

In some examples of the present disclosure, the method may further include the following steps after determining the distribution relationship based on the development height of the water-conducting fracture zone and the position of the weathered bedrock.

In response to determining the distribution relationship indicating that the development height of the water-conducting fracture zone extends into the weathered bedrock, a second determination result about whether the development height of the water-conducting fracture zone reaches the position of the loose aquifer may be determined.

In response to determining the second determination result is negative, a third determination result about whether the loose aquifer migrates to recharge the weathered bedrock.

In response to determining the third determination result is affirmative, a fourth determination result about whether there exists an abnormal water-rich zone within the development height of the water-conducting fracture zone may be determined.

In response to determining the fourth determination result is affirmative, the target grouting control strategy for the post-mining coal seam roof strata may be determined as grouting at the position of the weathered bedrock and implementing a curve branch borehole drilling and grouting in each aquiclude beneath each abnormal water-rich zone in an aquifer within the development height of the water-conducting fracture zone.

In response to determining the fourth determination result is negative, the target grouting control strategy for the post-mining coal seam roof strata may be determined as grouting at the position of the weathered bedrock, grouting and repairing the aquiclude within the development height of the water-conducting fracture zone to reconstruct the aquiclude.

In the above schemes, if the water-conducting fractured zone extends into the weathered bedrock, whether the water-conducting fractured zone further penetrates into the loose aquifer may be determined. If the fractured zone does not penetrate into the loose aquifer, whether the loose aquifer provides a cross-flow recharge to the aquifers of the weathered bedrock may then be assessed. If the water-conducting fractured zone further penetrates into the loose aquifer, the presence of an abnormal water-rich zone within the water-conducting fractured zone may be evaluated. If such an abnormal water-rich zone exists, the target grouting control strategy for the post-mining coal seam roof strata may be defined as follows. At first, a vertical borehole may be constructed with its terminus positioned within the weathered bedrock beneath the loose aquifer. Then, the weathered bedrock may be grouted. Simultaneously, a curved branch borehole may be drilled and grouted on each aquiclude beneath each abnormal water-rich zone in an aquifer within the developmental height of the fractured zone. This procedure may repair rock layers damaged by the water-conducting fractured zone, create local aquicludes, and then connects these repaired aquicludes via controlled branch borehole advancement to form a unified, continuous aquiclude.

If no abnormal water-rich zone exists, the target grouting control strategy may be defined as follows. At first, a vertical borehole may be constructed with its terminus positioned within a weathered bedrock beneath the loose aquifer. Then, the weathered bedrock may be grouted. Additionally, a curved branch borehole may be drilled and grouted on each aquiclude beneath the each aquifer within the developmental height of the water-conducting fractured zone. This procedure may not only repair the aquicludes damaged but also form a unified, continuous aquiclude.

In some examples of the present disclosure, the method may further include the following steps after determining the second determination result is negative and determining the third determination result about whether the loose aquifer migrates to recharge the weathered bedrock.

In response to determining the third determination result is negative, a fifth determination result about whether there exists an abnormal water-rich zone within the development height of the water-conducting fracture zone may be determined.

In response to determining the fifth determination result is affirmative, the target grouting control strategy for the post-mining coal seam roof strata may be determined as implementing a curve branch borehole drilling and grouting in the aquiclude of the abnormal water-rich zone within each aquifer within the development height of the water-conducting fracture zone.

In response to determining the fifth determination result is negative, the target grouting control strategy for the post-mining coal seam roof strata may be determined as grouting and repairing the aquicludes within the development height of the water-conducting fracture zone, and reconstructing the aquicludes.

In the above schemes, if the loose aquifer does not provide a cross-flow recharge to the aquifers in the weathered bedrock, whether there is an abnormal water-rich zone within the water-conducting fractured zone may be determined. If such an abnormal water-rich zone exists, the target grouting control strategy for the post-mining coal seam roof strata may be defined as follows. At first a curved branch borehole may be drilled and grouted in each aquiclude beneath each abnormal water-rich zone in the aquifer within the developmental height of the water-conducting fractured zone. This procedure may repair the aquicludes damaged by the water-conducting fractured zone, and then connect these aquicludes via the curved branch borehole to form a unified, continuous aquiclude. If no such an abnormal water-rich zone exists, the target grouting control strategy may be defined as the following. At first, a curved branch borehole may be drilled and grouted in each aquiclude beneath the aquifer within the developmental height of the water-conducting fractured zone. This procedure does not only repair the aquiclude damaged but also form a new unified, continuous aquiclude.

In some examples of the present disclosure, the method may further include the following steps after determining the distribution relationship indicating that the development height of the water-conducting fracture zone extends into the weathered bedrock and determining a second determination result about whether the development height of the water-conducting fracture zone is within the loose aquifer.

In response to determining the second determination result is affirmative, a sixth determination result about whether the development height of the water-conducting fracture zone penetrates into the weathered bedrock may be determined.

In response to determining the sixth determination result is affirmative, the target grouting control strategy for the post-mining coal seam roof strata may be determined as grouting the weathered bedrock and drilling and grouting a curved branch borehole in the caving zone within the development height of the water-conducting fracture zone.

In response to determining the sixth determination result is negative, the target grouting control strategy may be determined as drilling and grouting a curved branch borehole in the caving zone at the development height of the water-conducting fracture zone.

In the above schemes, if the water-conducting fractured zone extends into the loose aquifer, whether there is a water-conducting fractured zone penetrates into the weathered bedrock may be determined. If there is a water-conducting fractured zone penetrates into the weathered bedrock, the weathered bedrock may be defined as an ultra-thin bedrock. Moreover, the target grouting control strategy for the post-mining coal seam roof strata may involve the following. At first, a borehole may be drilled with its terminus positioned within the weathered bedrock beneath the loose aquifer. Then, the weathered bedrock may be grouted. Moreover, a curved branch borehole may be drilled and grouted above the caving zone. Therefore, a dual-gradient grouting scheme on both grouting materials and grouting pressures may be applied to form a reconstructed aquiclude.

If the water-conducting fractured zone does not penetrate into the weathered bedrock, the weathered bedrock may be defined as a thin bedrock. Moreover, the target grouting control strategy for the post-mining coal seam roof strata may involve drilling and grouting a curved branch borehole above the caving zone. Moreover, a dual-gradient grouting scheme on both the grouting materials and the grouting pressures may be applied to form a reconstructed aquiclude.

Figure 2:
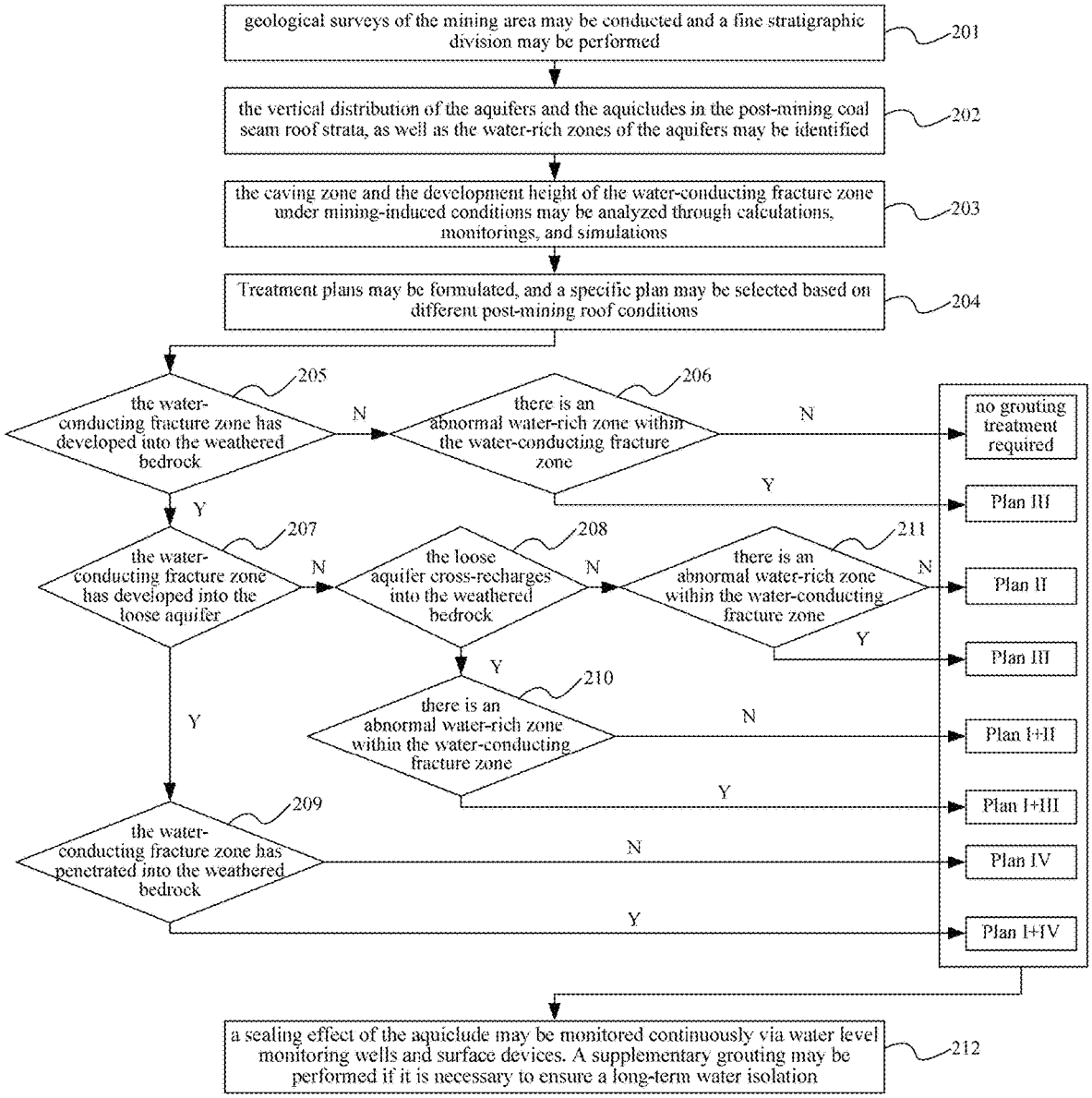
FIG. 2 is a flowchart of a post-mining water-resisting layer reconstruction method through partition grouting for a coal-measure aquifer in coal seam roof strata according to other examples of the present disclosure.

In some examples of the present disclosure, a schematic diagram of the post-mining water-resisting layer reconstruction method through partition grouting for a coal-measure aquifer in coal seam roof strata is illustrated in FIG. 2.

In block 201, geological surveys of the mining area may be conducted and a fine stratigraphic division may be performed.

In block 202, the vertical distribution of the aquifers and the aquicludes in the post-mining coal seam roof strata, as well as the water-rich zones of the aquifers may be identified.

In block 203, the caving zone and the development height of the water-conducting fracture zone under mining-induced conditions may be analyzed through calculations, monitoring, and simulations.

In block 204, grouting control plans may be formulated (Plan I, II, III, and IV), and a specific plan (i.e., the target grouting control strategy) may be selected based on different post-mining roof conditions.

Figure 3:
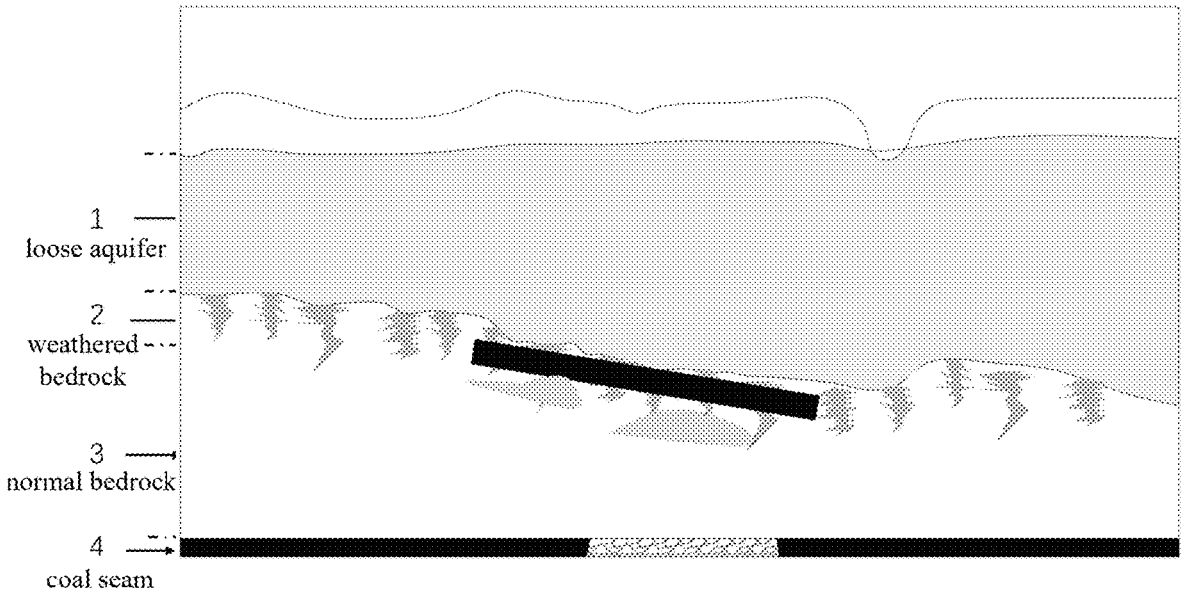
FIG. 3 is a schematic diagram of Plan I according to examples of the present disclosure.

As shown in FIG. 3, which shows Plan I, boreholes with the terminal ends located in the weathered bedrock beneath the loose aquifer may be drilled and grouted at first. Then, grouting may be conducted to modify the weathered bedrock.

Figure 4:
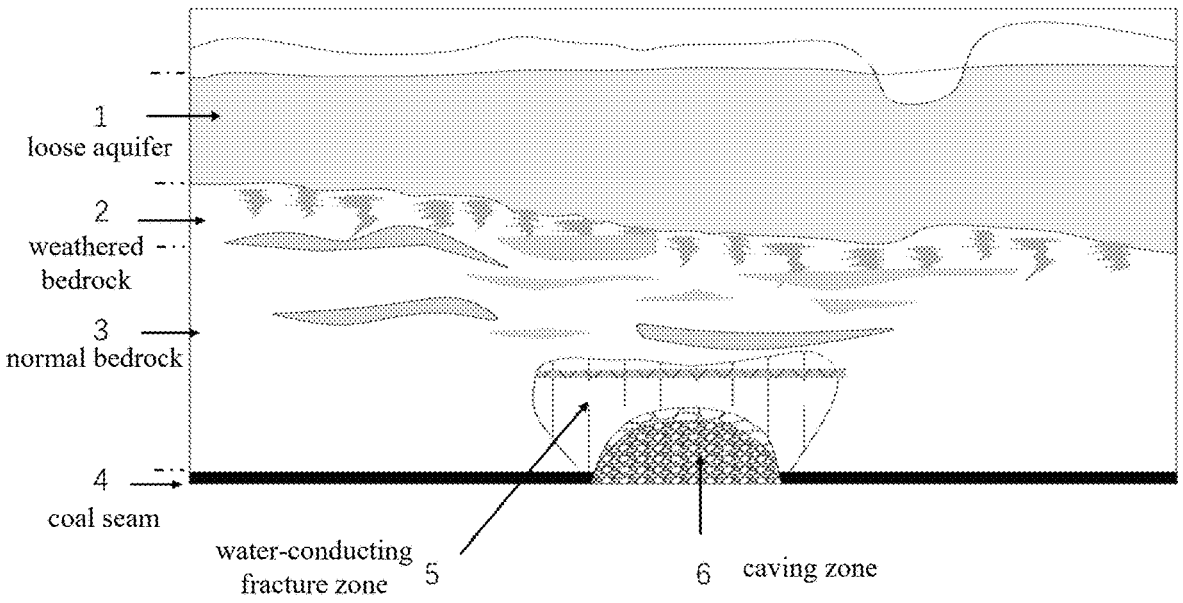
FIG. 4 is a schematic diagram of Plan II according to examples of the present disclosure.

As shown in FIG. 4, which shows Plan II, curved branch boreholes positioned within the aquicludes may be drilled and grouted below the water-rich zones of the aquifers and within the development height of the water-conducting fracture zone at first. This approach aims to repair the aquicludes damaged by the water-conducting fracture zone while creating a new unified, continuous aquiclude.

Figure 5:
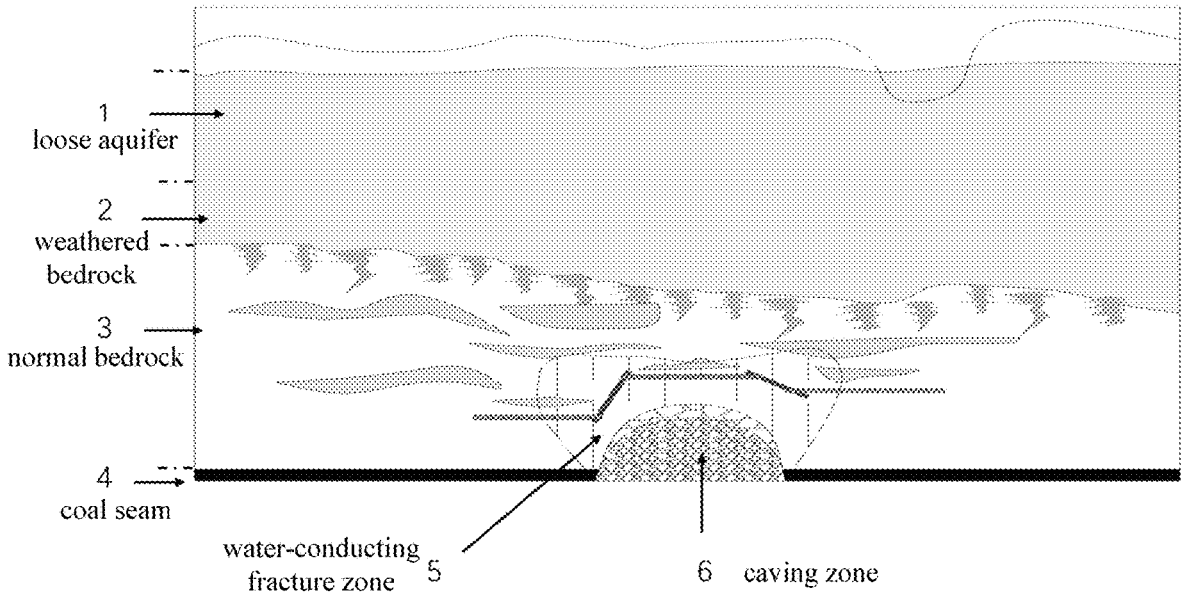
FIG. 5 is a schematic diagram of Plan III according to examples of the present disclosure.

As shown in FIG. 5, which shows Plan III, curved branch boreholes may be drilled and grouted below the aquicludes of each independent water-rich zone within the water-conducting fracture zone. This approach repairs the rock layers damaged by the water-conducting fracture zone, creating local aquicludes. Subsequently, by controlling the advancement direction of the branch boreholes, the local aquicludes may be grout-connected to form a new unified, continuous aquiclude.

Figure 6:
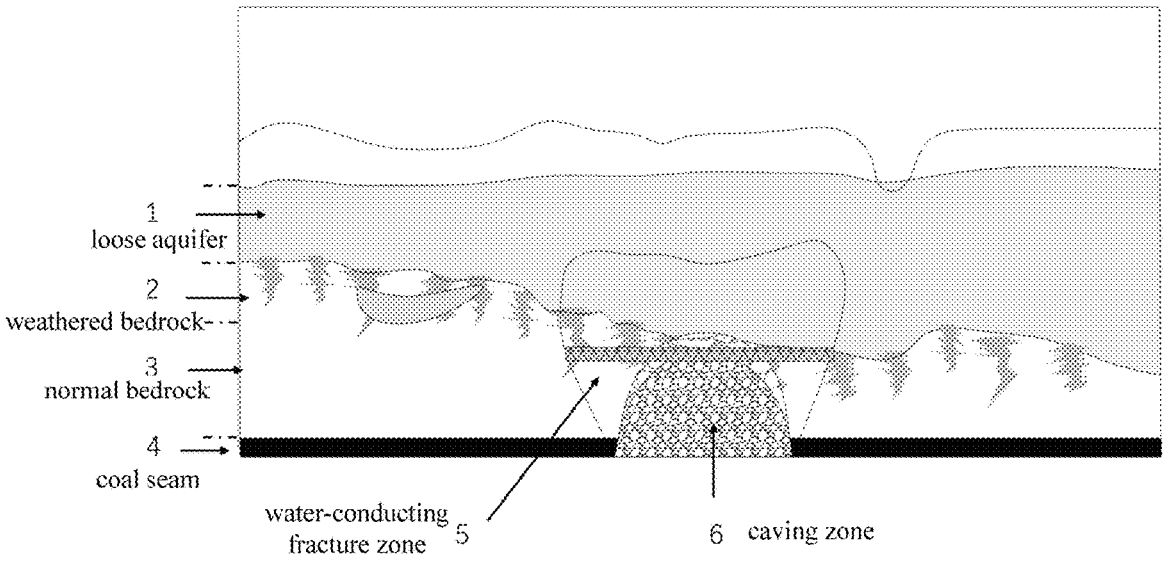
FIG. 6 is a schematic diagram of Plan IV according to examples of the present disclosure.

As shown in FIG. 6, which shows Plan IV, curved branch boreholes may be drilled and grouted above the caving zone, and a dual-gradient grouting scheme on both grout particle sizes and injection pressures may be implemented to reconstruct the aquiclude.

For post-mining scenarios, eight distinct grouting control strategies may be formulated as follows.

Scenario 1, if the water-conducting fracture zone does not extend into the weathered bedrock and contains no abnormal water-rich zones, no grouting treatment is required.

Scenario 2, if the water-conducting fracture zone does not extend into the weathered bedrock but contains an abnormal water-rich zone, Plan II may be implemented.

Scenario 3, if the water-conducting fracture zone extends into the weathered bedrock, no cross-flow recharge occurs from the loose aquifer to the weathered bedrock, and the water-conducting fracture zone contains no abnormal water-rich zone, Plan II may be implemented.

Scenario 4, if the water-conducting fracture zone extends into the weathered bedrock, no cross-flow recharge occurs from the loose aquifer to the weathered bedrock, but the water-conducting fracture zone contains abnormal water-rich zones, Plan III may be applied.

Scenario 5, if the water-conducting fracture zone extends into the weathered bedrock, cross-flow recharge occurs from the loose aquifer to the weathered bedrock, and the water-conducting fracture zone contains no abnormal water-rich zones, Plan I+Plan II may be combined.

Scenario 6, if the water-conducting fracture zone extends into the weathered bedrock, cross-flow recharge occurs from the loose aquifer to the weathered bedrock, and the water-conducting fracture zone contains abnormal water-rich zones, Plan I+Plan III may be combined.

Scenario 7, if the water-conducting fracture zone does not penetrate into the weathered bedrock, Plan IV may be executed.

Scenario 8, if the water-conducting fracture zone penetrates into the weathered bedrock, Plan I+Plan IV may be implemented.

Regarding the dual-gradient grouting scheme on both grout particle sizes and injection pressures in Plan IV, the specifics steps may be as follows. At first, two kinds of grout particle sizes are preset: large-particle grout and small-particle grout. Where, the large-particle grout may be composed of aggregate-clay-cement-water slurry and is used to fill large fractures. The small-particle grout may be composed of cement-clay-waterglass-water slurry and is used to fill remaining finer fractures. In the process of grouting, a slurry of the large-particle grout may be injected to fill large fractures. After the slurry of the large-particle grout solidifies, a slurry of the small-particle grout may be injected to fill smaller residual fractures. Moreover, two levels of injection pressures are preset: low pressure and high pressure. In the process of grouting, the low pressure may be applied when injecting the slurry of the large-particle grout to control a grout spread while filling large fractures. Then, the high pressure may be applied for grouting the slurry of the small-particle grout to ensure an effective filling of fine fractures.

In block 205, whether the water-conducting fracture zone has developed into the weathered bedrock may be determined. If the water-conducting fracture zone has not developed into the weathered bedrock (N), proceed to block 206. If the water-conducting fracture zone has developed into the weathered bedrock (Y), proceed to block 207.

In block 206, whether there is an abnormal water-rich zone within the water-conducting fracture zone is checked. If there is no abnormal water-rich zone within the water-conducting fracture zone (N), the target grouting control strategy for the post-mining coal seam roof strata may be determined as no grouting treatment required. If there is an abnormal water-rich zone within the water-conducting fracture zone (Y), the target grouting control strategy may be set to Plan III. That is, curved branch boreholes may be drilled and grouted in the aquicludes below each abnormal water-rich zone within the development height of the water-conducting fracture zone. Then, the aquicludes damaged by the water-conducting fracture zone may be repaired, and the aquicludes may be connected by controlling the advancement directions of the branch boreholes to form a continuous aquiclude.

In block 207, whether the water-conducting fracture zone has developed into the loose aquifer may be determined. If the water-conducting fracture zone has not developed into the loose aquifer (N), proceed to block 208. If the water-conducting fracture zone has developed into the loose aquifer (Y), proceed to block 209.

In block 208, whether the loose aquifer cross-recharges into the weathered bedrock may be assessed. If the loose aquifer cross-recharges into the weathered bedrock (Y), proceed to block 210. If the loose aquifer does not cross-recharges into the weathered bedrock (N), proceed to block 211.

In block 209, whether the water-conducting fracture zone has penetrated into the weathered bedrock may be determined. If the water-conducting fracture zone has penetrated into the weathered bedrock (Y), the weathered bedrock may be determined as an ultra-thin bedrock, and the target grouting control strategy for the post-mining coal seam roof strata may be determined as Plan I+Plan IV. Specifically, in Plan I, boreholes terminating in the weathered bedrock beneath the loose aquifer may be drilled and grout may be injected in to the boreholes to modify the weathered bedrock. In Plan IV, a dual-gradient grouting (on both grout materials and grouting pressures) may be performed via curved branch boreholes above the caving zone to reconstruct the aquiclude. If the water-conducting fracture zone has not penetrated into the weathered bedrock (N), the weathered bedrock may be determined as a thin bedrock, and the target grouting control strategy for the post-mining coal seam roof strata may be determined as Plan IV. Specifically, In Plan IV, a dual-gradient grouting (on both grout materials and grouting pressures) may be performed via curved branch boreholes above the caving zone to reconstruct the aquiclude.

In block 210, whether there is an abnormal water-rich zone within the water-conducting fracture zone may be determined. If there is an abnormal water-rich zone within the water-conducting fracture zone (Y), the target grouting control strategy for the post-mining coal seam roof strata may be determined as Plan I+Plan III. Specifically, in Plan I, boreholes terminating in the weathered bedrock beneath the loose aquifer may be drilled and grout may be injected in to the boreholes to modify the weathered bedrock. In Plan III, curved branch boreholes may be drilled and grouted in the aquicludes below each abnormal water-rich zone within the development height of the water-conducting fracture zone. Then, the aquicludes damaged by the water-conducting fracture zone may be repaired, and the aquicludes may be connected by controlling the advance directions of the branch boreholes to form a continuous aquiclude. If there is no abnormal water-rich zone within the water-conducting fracture zone (N), the target grouting control strategy for the post-mining coal seam roof strata may be determined as Plan I+Plan II. Specifically, in Plan I, boreholes terminating in the weathered bedrock beneath the loose aquifer may be drilled and grout may be injected in to the boreholes to modify the weathered bedrock. In Plan II, curved branch boreholes may be drilled and grouted in the aquiclude below the water-rich zones to create a new aquiclude.

In block 211, whether there is an abnormal water-rich zone within the water-conducting fracture zone may be determined. If there is an abnormal water-rich zone within the water-conducting fracture zone (Y), the target grouting control strategy for the post-mining coal seam roof strata may be determined as Plan III. Specifically, in Plan III, curved branch boreholes may be drilled and grouted in the aquiclude below each abnormal water-rich zone within the development height of the water-conducting fracture zone. Then, the aquicludes damaged by the water-conducting fracture zone may be repaired, and the aquicludes may be connected by controlling the advancement directions of the branch boreholes to form a continuous aquiclude. If there is no abnormal water-rich zone within the water-conducting fracture zone (N), the target grouting control strategy for the post-mining coal seam roof strata may be determined as Plan II. Specifically, in Plan II, curved branch boreholes may be drilled and grouted in the aquiclude below the water-rich zones to create a new aquiclude.

In block 212, a sealing effect of the aquiclude may be monitored continuously via water level monitoring wells and surface devices. A supplementary grouting may be performed if it is necessary to ensure a long-term water isolation.

Figure 7:
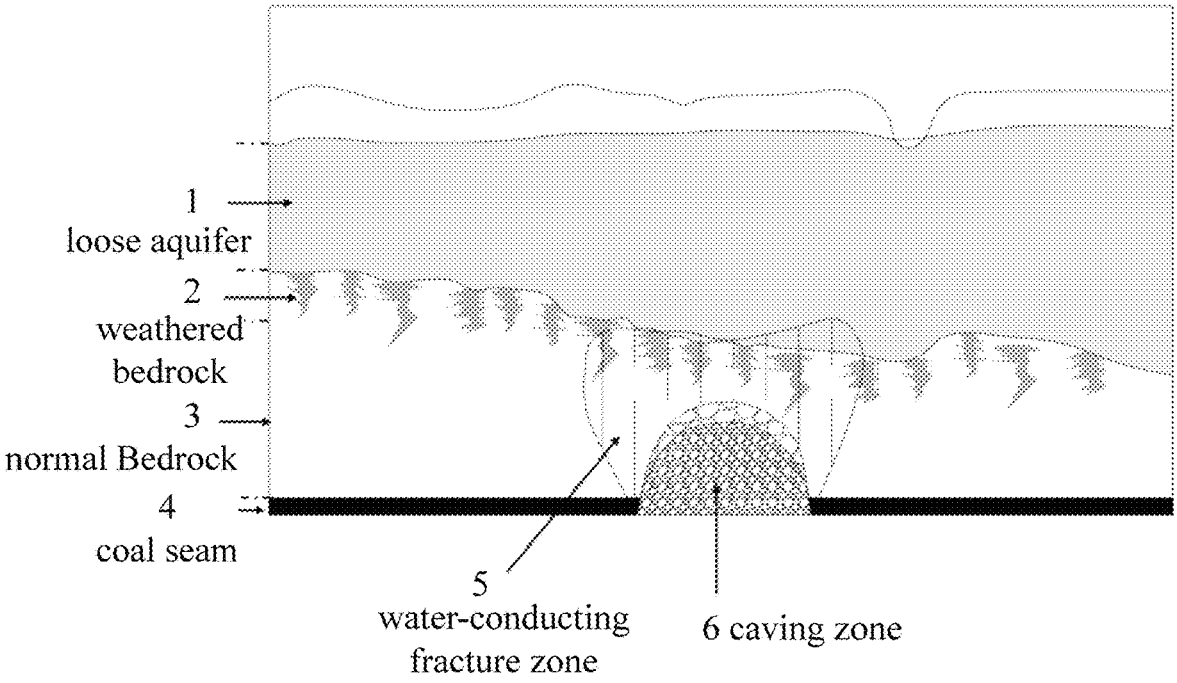
FIG. 7 is a schematic diagram of rock strata in the post-mining coal seam roof strata according to examples of the present disclosure.

Additionally, FIG. 7 illustrates a stratigraphic schematic of the post-mining coal seam roof strata in the target mining area.

By judging different bedrock conditions, the distributions of water-rich zones in the aquifers, the height of the caving zone, and the development height of the water-conducting fracture zone, this application can select different schemes for grouting treatment, which can modify the loose aquifer, repair the aquiclude damaged, thereby preventing post-mining roof water sources from entering the goaf, reducing mine water inflow, and protecting the groundwater system.

In some examples, after the mining work is completed, if the water inflow in the goaf exceeds a normal value, a hydrochemical analysis of the water in the goaf may be conducted to determine which the water-rich zones are the sources of water inflow, and then targeted grouting and aquiclude reconstruction may be performed. The process may be as follows. At first, a position of the aquifer may be determined based on borehole data. The water-conducting fracture zone may be predicted to preliminarily identify the positions of the water-rich zones. After mining, when the water inflow reaches 80% of the mine's designed drainage capacity, aquiclude reconstruction may be required. A precise hydrochemical analysis may be conducted to locate the water inflow source and formulate corresponding grouting strategies. The method for identifying the water inflow source may be achieved by coupling hydrochemical field and hydrodynamic field tracer simulation for mine water inrush (or sudden water inflow) source identification. The comprehensive identification results are based on the coupling of hydrochemical field machine learning analysis and hydrodynamic field backward tracer simulation for mine water inrush (or sudden water inflow) source identification.

In the above grouting process, a grouting scope may be determined by one of the following schemes.

In Scheme I, a bottom interface of the weathered bedrock may be selected as a treatment horizon. Further, a grout diffusion radius (R) may be calculated using an empirical formula as $$R = \sqrt[3]{\frac{3rKCpt}{NC_1} + r}.$$

Then, the position of the grouting hole may be set at a distance of R/2 above the bottom interface of the weathered bedrock. Moreover, a width of the grouting hole may be set as about 50 m outward from the working face.

In Scheme II, a top interface of the water-conducting fracture zone may be taken as a grouting horizon by analyzing the development of the water-conducting fracture zone. The position of the grouting hole may be set at a distance of R/2 below the top interface of the water-conducting fracture zone. Moreover, a width of the grouting hole may be set as about 50 m outward along a horizontal direction of the development zone of the water-conducting fracture zone.

In Scheme III, a trend line of the aquiclude may be determined based on a location of the water inflow source. The position of the grouting hole may be set at a distance of R/2 below a bottom interface of the aquifer. Moreover, a grouting boundary may be set as about 50 m outward the location of the water inflow source.

In Scheme IV, a top interface of the caving zone as a grouting horizon by analyzing the development of the caving zone. The position of the grouting hole may be set at a distance of R/2 above the top interface of the caving zone. Moreover, a width of the grouting hole may be set as about 50 m outward along a horizontal direction of the development of the water-conducting fracture zone.

In the grouting process, if the borehole does not encounter the target layer and experiences a minor fluid loss, a leak-sealing agent may be used to plug the loss and the drilling may be continued. If a severe fluid loss occurs, a thick cement slurry may be used to seal the loss before resuming drilling.

When drilling along the target layer, the grouting may be performed in every 30 m (or restart a 30 m count from a leakage point). Further, grouting may be performed at branch terminal holes and grouting may be performed once a leakage is detected. Moreover, if no leakage occurs in the entire branch borehole, a high-pressure grouting may be performed in every 30 m or at terminal holes of the branch boreholes.

Further, for weathered bedrock areas, clay-cement grout primarily composed of clay slurry with small amounts of cement and sodium silicate may be used. Generally, a typical volume percentage of each component of the clay-cement grout may include: clay slurry with a volume percentage of 90%-96%, cement with a volume percentage of 3%-6% and sodium silicate with a volume percentage of 1.5%-3%.

Specifically, the water-conducting fracture zone may adopt a cement single-fluid grouting with the following protocols. For normal zones (a leakage <3 $m^3$/h), a water-cement ratio (W/C) of 3:1 (specific gravity 1.2) may be used as a start. The concentration may be increased gradually to 2.5:1, 2:1, 1.5:1, and 1:1, if no pressure builds at the wellhead. Once a stable pressure reaches the grouting termination standard, 3:1 dilute slurry may be used for pressure stabilization to obtain grouting parameters. For weak leakage zones (a leakage >3 $m^3$/h but not fully lost), a water-cement ratio (W/C) of 3:1 or 2:1 (depending on leakage severity) may be used as a start. The concentration may be increased gradually to 2.5:1, 2:1, and 1:1 if no pressure builds. Intermittent grouting may be considered as an alternative. For severe leakage zones (Fully lost), a water-cement ratio (W/C) of 2:1 may be used as a start. The concentration may be increased gradually to 1:1. Accelerators and intermittent grouting may be considered as alternatives.

Moreover, two standards may be designed as grouting termination criteria. Specifically, according to one grouting termination criteria, a grouting may be terminated, when a pump rate is less than or equal to 30 L/min, and a grouting pressure reaches a termination standard from the test and is stabilized for no less than 30 minutes. According to the other grouting termination criteria, even though the grouting pressure fails to meet the termination standard, the grouting may be terminated when a grout volume meets a design requirement.

It should be noted that the method according to examples of the present application can be executed by a single device, such as a computer or a server. The method can also be applied in a distributed scenario, where multiple devices cooperate with each other to complete the method. In such a distributed scenario, one of the multiple devices may only execute one or more steps in the method according to examples of the present application, and the multiple devices will interact with each other to complete the method.

It should be noted that some examples of the present disclosure have been described above. Other examples are within the scope of the present disclosure. In some cases, the actions or steps recited can be performed in an order different from that in the above-described examples and still achieve desirable results. In addition, the processes depicted in the accompanying drawings do not necessarily require the particular order shown, or sequential order, to achieve desirable results. In some implementations, multitasking and parallel processing are also possible or may be advantageous.

On the same inventive concept, corresponding to the method of any of the foregoing examples, the present disclosure also provides a post-mining water-resisting layer reconstruction device through partition grouting for a coal-measure aquifer in coal seam roof strata according to examples of the present disclosure.

Figure 8:
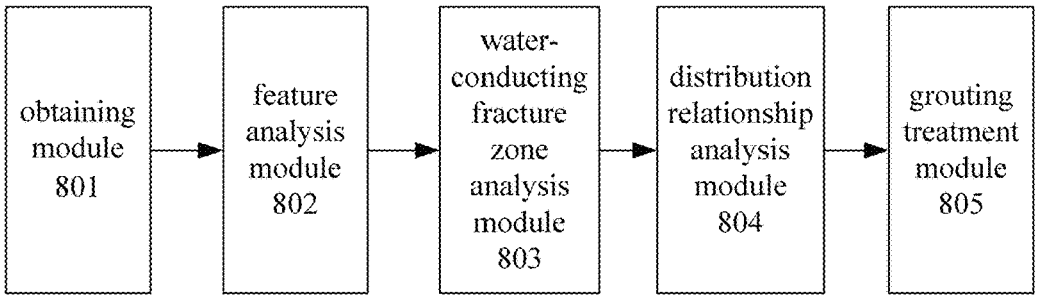
FIG. 8 is a structural block diagram of a post-mining water-resisting layer reconstruction device through partition grouting for a coal-measure aquifer in coal seam roof strata according to examples of the present disclosure.

As shown in FIG. 8, the post-mining water-resisting layer reconstruction device may include an obtaining module 801, a feature analysis module 802, a water-conducting fracture zone analysis module 803, a distribution relationship analysis module 804 and a grouting control module 805.

Specifically, the obtaining module 801 may be configured to obtain geological parameters of a target mining area and determine strata distribution parameters of the target mining area based on the geological parameters.

The feature analysis module 802 may be configured to perform a feature analysis processing on the strata distribution parameters through a distribution feature algorithm to determine hydrogeological characteristics of coal seam roof strata in the target mining area.

The water-conducting fracture zone analysis module 803 may be configured to perform a water-conducting fracture zone analysis on the hydrogeological characteristics through a numerical simulation algorithm to determine a development height of a water-conducting fracture zone.

The distribution relationship analysis module 804 may be configured to perform a distribution relationship analysis according to the development height of the water-conducting fracture zone and the hydrogeological characteristics through a distribution relationship algorithm to obtain a distribution relationship between the development height of the water-conducting fracture zone and the hydrogeological characteristics and determine a target grouting control strategy for a post-mining coal seam roof strata based on the distribution relationship.

The grouting control module 805 may be configured to implement a grouting control on the post-mining coal seam roof strata according to the target grouting control strategy.

In some examples of the present disclosure, the obtaining module 801 may specifically be configured to conduct a geological structure analysis of strata where the target mining area is located based on the geological parameters to obtain a geological structure analysis result; obtain a comparison result by comparing the geological structure parameters of different predefined strata with the geological structure analysis result; and divide the strata where the target mining area is located based on the comparison result to obtain the strata distribution parameters of the target mining area.

In some examples of the present disclosure, the feature analysis module 802 may specifically be configured to conduct a groundwater flow simulation based on the stratigraphic distribution to obtain a groundwater flow simulation result and determine the hydrogeological characteristics of the coal seam roof strata in the target mining area based on the groundwater flow simulation result.

In some examples of the present disclosure, the water-conducting fracture zone analysis module 803 may specifically be configured to construct a geological feature simulation model of the strata in the target mining area based on the hydrogeological characteristics; simulate stopping of the strata in the target mining area through the geological feature simulation model according to a predefined mining thickness threshold to obtain a height of a water-conducting fracture zone and/or a height of a caving zone of overlying strata; and take the height of the water-conducting fracture zone and/or the height of the caving zone of the overlying strata as the development height of the water-conducting fracture zone.

In some examples of the present disclosure, the hydrogeological characteristics may include a position of a weathered bedrock, a position of a loose aquifer, and/or a position of one or more abnormal water-rich zones.

In some examples of the present disclosure, the distribution relationship analysis module 804 may specifically be configured to determine the distribution relationship based on the development height of the water-conducting fracture zone and the position of the weathered bedrock; in response to determining the distribution relationship indicating that the development height of the water-conducting fracture zone does not extend into the weathered bedrock, determine a first determination result about whether there exists an abnormal water-rich zone within the development height of the water-conducting fracture zone; in response to determining the first determination result is negative, determine the target grouting control strategy for the post-mining coal seam roof strata as no grouting treatment required; and in response to determining the first determination result is affirmative, the target grouting control strategy for the post-mining coal seam roof strata may be determined as performing a curve branch borehole drilling and grouting in each aquiclude beneath each abnormal water-rich zone in an aquifer located within the development height of the water-conducting fracture zone.

In some examples of the present disclosure, the post-mining water-resisting layer reconstruction device may further include a first grouting control strategy determination module. Where, after determining the distribution relationship based on the development height of the water-conducting fracture zone and the position of the weathered bedrock, the first grouting control strategy determination module may specifically be configured to in response to determine the distribution relationship indicating that the development height of the water-conducting fracture zone extends into the weathered bedrock, determine a second determination result about whether the development height of the water-conducting fracture zone reaches the position of the loose aquifer; in response to determining the second determination result is negative, determine a third determination result about whether the loose aquifer migrates to recharge the weathered bedrock; in response to determining the third determination result is affirmative, determine a fourth determination result whether there exists an abnormal water-rich zone within the development height of the water-conducting fracture zone; in response to determining the fourth determination result is affirmative, determine the target grouting control strategy for the post-mining coal seam roof strata as grouting at the position of the weathered bedrock and implementing a curve branch borehole drilling and grouting in each aquiclude beneath each abnormal water-rich zone in the aquifer within the development height of the water-conducting fracture zone; and in response to determining the fourth determination result is negative, determine the target grouting control strategy for the post-mining coal seam roof strata as grouting at the position of the weathered bedrock, grout and repair each aquiclude within the development height of the water-conducting fracture zone, and reconstruct the aquiclude.

In some examples of the present disclosure, the post-mining water-resisting layer reconstruction device may further include a second grouting control strategy determination module. Where, after determining the second determination result is negative and determining the third determination result about whether the loose aquifer migrates to recharge the weathered bedrock, the second grouting control strategy determination module may specifically be configured to in response to determining the third determination result is negative, determine a fifth determination result about whether there exists an abnormal water-rich zone within the development height of the water-conducting fracture zone; in response to determining the fifth determination result is affirmative, determine the target grouting control strategy for the post-mining coal seam roof strata as implementing a curve branch borehole drilling and grouting in an aquiclude beneath each abnormal water-rich zone in an aquifer located at the development height of the water-conducting fracture zone; and in response to determining the fifth determination result is negative, determine the target grouting control strategy for the post-mining coal seam roof strata as grout and repair the aquiclude within the development height of the water-conducting fracture zone, and reconstruct the aquiclude.

In some examples of the present disclosure, the post-mining water-resisting layer reconstruction device may further include a third grouting control strategy determination module. Where, after determining the distribution relationship indicating that the development height of the water-conducting fracture zone extends into the weathered bedrock and determining a second determination result about whether the development height of the water-conducting fracture zone reaches the position of the loose aquifer, the third grouting control strategy determination module may specifically be configured to in response to determining the second determination result is affirmative, determine a sixth determination result about whether the development height of the water-conducting fracture zone penetrates into the weathered bedrock; in response to determining the sixth determination result is affirmative, determine the target grouting control strategy for the post-mining coal seam roof strata as grouting at the position of the weathered bedrock and implement a curved branch borehole drilling and grouting in a caving zone within the development height of the water-conducting fracture zone; and in response to determining the sixth determination result is negative, determine the target grouting control strategy as implement a curved branch borehole drilling and grouting in the caving zone within the development height of the water-conducting fracture zone.

For the sake of description, the above system is described by dividing it into various functional modules. Of course, when implementing the present application, the functions of each module may be realized in the same or multiple software and/or hardware.

The system of the above examples may be used to implement the corresponding method in any of the preceding examples and has the beneficial effects of the corresponding method, which will not be elaborated here.

On the same inventive concept, corresponding to the method of any of the foregoing examples, the present disclosure also provides an electronic device, comprising: a memory, a processor, and a computer program stored on the memory and executable by the processor, wherein the processor implements the post-mining water-resisting layer reconstruction method described in any of the foregoing examples when executing the computer program.

Figure 9:
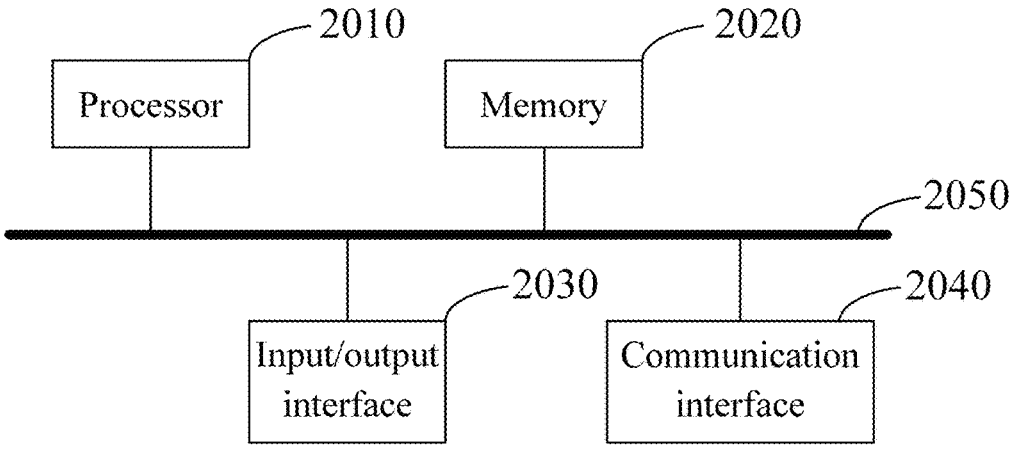
FIG. 9 is a schematic diagram illustrating a hardware structure of an electronic device according to examples of the present disclosure.

FIG. 9 illustrates a more detailed hardware structure diagram of an electronic device according to this example. The device may include: a processor 2010, a memory 2020, an input/output interface 2030, a communication interface 2040, and a bus 2050. The processor 2010, memory 2020, input/output interface 2030, and communication interface 2040 are communicatively connected within the device via the bus 2050.

The processor 2010 may be implemented using a general-purpose CPU (Central Processing Unit), microprocessor, ASIC (Application-Specific Integrated Circuit), or one or more integrated circuits. It is configured to execute related programs to implement the technical solutions provided in the examples of the present specification.

The memory 2020 may be implemented using ROM (Read-Only Memory), RAM (Random Access Memory), static storage devices, or dynamic storage devices. The memory 2020 stores operating systems and other applications. When implementing the technical solutions of the examples of the present specification via software or firmware, related program codes are stored in the memory 2020 and invoked by the processor 2010 for execution.

The input/output interface 2030 is connected to an input/output module to enable information input and output. The input/output module may be integrated into the device (not shown) or externally connected to provide corresponding functions. Input devices may include keyboards, mice, touchscreens, microphones, and various sensors. Output devices may include displays, speakers, vibrators, and indicator lights.

The communication interface 2040 is connected to a communication module (not shown) to enable communication between the device and other devices. The communication module may use wired methods (e.g., USB, network cables) or wireless methods (e.g., mobile networks, Wi-Fi, Bluetooth).

The bus 2050 provides a pathway for transmitting information among components (e.g., processor 2010, memory 2020, input/output interface 2030, and communication interface 2040) of the device.

It should be noted that although the above device illustrates only the processor 2010, memory 2020, input/output interface 2030, communication interface 2040, and bus 2050, additional components necessary for normal operation may be included in practical implementations. Furthermore, those skilled in the art will understand that the device may include only components necessary for implementing the solutions of the examples of the present specification and need not include all components shown in the figure.

The electronic device in the above examples is used to implement the post-mining water-resisting layer reconstruction method in any of the preceding examples and has the beneficial effects of the corresponding method, which are not repeated here.

Based on the same inventive concept and corresponding to any of the above method, the present disclosure further provides a non-transitory computer-readable storage medium storing computer instructions. The computer instructions are configured to cause a computer to execute the post-mining water-resisting layer reconstruction method as described in any of the preceding examples.

The computer-readable medium in this example includes permanent and non-permanent, removable and non-removable media implemented by any method or technology for information storage. The information may be computer-readable instructions, data structures, program modules, or other data. Examples of computer storage media include, but are not limited to: phase-change memory (PRAM), static random-access memory (SRAM), dynamic random-access memory (DRAM), other types of RAM, read-only memory (ROM), electrically erasable programmable read-only memory (EEPROM), flash memory, other memory technologies, CD-ROM, DVD, other optical storage, magnetic cassettes, magnetic tape storage, other magnetic storage devices, or any other non-transitory media capable of storing information accessible to computing devices.

The storage medium in the above examples stores computer instructions for causing a computer to execute the post-mining water-resisting layer reconstruction method as described in any of the preceding examples, with the beneficial effects of the corresponding method, which are not repeated here.

Those skilled in the art should understand that the discussion of the above examples is exemplary and not intended to imply that the scope of the present disclosure (including the claims) is limited to these examples. Under the principles of the present disclosure, the technical features in the above examples or different examples may be combined, steps may be executed in any order, and many other variations exist as described in the different aspects of the examples of the present disclosure, which are not detailed for brevity.

Additionally, to simplify explanation and discussion and to avoid obscuring the examples of the present disclosure, known power/ground connections to integrated circuit (IC) chips and other components may or may not be shown in the provided figures. Furthermore, devices may be illustrated in block diagram form to avoid obscuring the examples, considering that implementation details of such block diagrams are highly platform-dependent (i.e., these details should be fully understandable to those skilled in the art). When specific details (e.g., circuits) are provided to describe exemplary examples of the present disclosure, it will be apparent to those skilled in the art that the examples may be practiced without these details or with modifications thereto. Thus, the descriptions are to be regarded as illustrative rather than restrictive.

Although the present disclosure has been described with reference to specific examples, many alternatives, modifications, and variations will be apparent to those skilled in the art based on the foregoing description. For example, other memory architectures (e.g., dynamic RAM (DRAM)) may be used in the discussed examples.

The examples of the present disclosure are intended to cover all such alternatives, modifications, and variations falling within the broad scope of the appended claims. Therefore, any omissions, modifications, equivalent substitutions, or improvements made within the spirit and principles of the examples of the present disclosure shall be included within the scope of protection of the present disclosure.

What is claimed is:

1. A post-mining water-resisting layer reconstruction method through partition grouting for a coal-measure aquifer in coal seam roof strata, the method comprising:

obtaining geological parameters of a target mining area, and determining strata distribution parameters of the target mining area based on the geological parameters;

performing a feature analysis processing on the strata distribution parameters through a distribution feature algorithm to determine hydrogeological characteristics of the coal seam roof strata in the target mining area;

performing a water-conducting fracture zone analysis on the hydrogeological characteristics through a numerical simulation algorithm to determine a development height of a water-conducting fracture zone;

performing a distribution relationship analysis according to the development height of the water-conducting fracture zone and the hydrogeological characteristics through a distribution relationship algorithm to obtain a distribution relationship between the development height of the water-conducting fracture zone and the hydrogeological characteristics, and determining a target grouting control strategy for a post-mining coal seam roof strata based on the distribution relationship; and implementing a grouting treatment on the post-mining coal seam roof strata according to the target grouting control strategy;

wherein the hydrogeological characteristics comprises: a position of a weathered bedrock, and/or a position of a loose aquifer, and/or a position of an abnormal water-rich zone;

wherein performing a distribution relationship analysis according to the development height of the water-conducting fracture zone and the hydrogeological characteristics through a distribution relationship algorithm to obtain a distribution relationship between the development height of the water-conducting fracture zone and the hydrogeological characteristics and determining a target grouting control strategy for a post-mining coal seam roof strata based on the distribution relationship comprises:

determining the distribution relationship based on the development height of the water-conducting fracture zone and the position of the weathered bedrock;

in response to determining the distribution relationship indicating that the development height of the water-conducting fracture zone does not extend into the weathered bedrock, determining a first determination result about whether there exists an abnormal water-rich zone within the development height of the water-conducting fracture zone;

in response to determining the first determination result is negative, determining the target grouting control strategy for the post-mining coal seam roof strata as no grouting treatment required; and in response to determining the first determination result is affirmative, determining the target grouting control strategy for the post-mining coal seam roof strata as performing a curve branch borehole drilling and grouting in each aquiclude beneath each abnormal water-rich zone within an aquifer within the development height of the water-conducting fracture zone;

wherein the method further comprises the following steps after determining the distribution relationship based on the development height of the water-conducting fracture zone and the position of the weathered bedrock:

in response to determining the distribution relationship indicating that the development height of the water-conducting fracture zone extends into the weathered bedrock, determining a second determination result about whether the development height of the water-conducting fracture zone reaches the position of the loose aquifer;

in response to determining the second determination result is negative, determining a third determination result about whether the loose aquifer migrates to recharge the weathered bedrock;

in response to determining the third determination result is affirmative, determining a fourth determination result whether there exists an abnormal water-rich zone within the development height of the water-conducting fracture zone;

in response to determining the fourth determination result is affirmative, determining the target grouting control strategy for the post-mining coal seam roof strata as grouting at the position of the weathered bedrock and implementing a curve branch borehole drilling and grouting in each aquiclude beneath each abnormal water-rich zone in an aquifer within the development height of the water-conducting fracture zone; and in response to determining the fourth determination result is negative, determining the target grouting control strategy for the post-mining coal seam roof strata as grouting at the position of the weathered bedrock, grouting and repairing each aquiclude within the development height of the water-conducting fracture zone to reconstruct the aquiclude;

wherein the method further comprises the following steps after determining the second determination result is negative and determining the third determination result about whether the loose aquifer migrates to recharge the weathered bedrock:

in response to determining the third determination result is negative, determining a fifth determination result about whether there exists an abnormal water-rich zone within the development height of the water-conducting fracture zone;

in response to determining the fifth determination result is affirmative, determining the target grouting control strategy for the post-mining coal seam roof strata as implementing a curve branch borehole drilling and grouting in each aquiclude beneath each abnormal water-rich zone in the aquifer within the development height of the water-conducting fracture zone; and in response to determining the fifth determination result is negative, determining the target grouting control strategy for the post-mining coal seam roof strata as grouting and repairing the aquiclude within the development height of the water-conducting fracture zone to reconstruct the aquiclude.

2. The method according to claim 1, wherein, determining strata distribution parameters of the target mining area based on the geological parameters comprises:

conducting a geological structure analysis of strata where the target mining area is located based on the geological parameters to obtain a geological structure analysis result;

obtaining a comparison result by comparing the geological structure parameters of different predefined strata with the geological structure analysis result; and dividing the strata where the target mining area is located based on the comparison result to obtain the strata distribution parameters of the target mining area.

3. The method according to claim 1, wherein, performing a feature analysis processing on the strata distribution parameters through a distribution feature algorithm to determine hydrogeological characteristics of the coal seam roof strata in the target mining area comprises:

conducting a groundwater flow simulation based on the stratigraphic distribution to obtain a groundwater flow simulation result; and determining the hydrogeological characteristics of the coal seam roof strata in the target mining area based on the groundwater flow simulation result.

4. The method according to claim 1, wherein, performing a water-conducting fracture zone analysis on the hydrogeological characteristics through a numerical simulation algorithm to determine a development height of a water-conducting fracture zone comprises:

constructing a geological feature simulation model of strata in the target mining area based on the hydrogeological characteristics;

simulating stopping of the strata in the target mining area through the geological feature simulation model according to a predefined mining thickness threshold to obtain a height of a water-conducting fracture zone of overlying strata and/or a height of a caving zone; and taking the height of the water-conducting fracture zone of the overlying strata and/or the height of the caving zone as the development height of the water-conducting fracture zone.

5. The method according to claim 1, further comprising the following steps after determining the distribution relationship indicating that the development height of the water-conducting fracture zone extends into the weathered bedrock and determining a second determination result about whether the development height of the water-conducting fracture zone reaches the position of the loose aquifer:

in response to determining the second determination result is affirmative, determining a sixth determination result about whether the development height of the water-conducting fracture zone penetrates into the weathered bedrock;

in response to determining the sixth determination result is affirmative, determining the target grouting control strategy for the post-mining coal seam roof strata as grouting at the position of the weathered bedrock and implementing a curved branch borehole drilling and grouting in a caving zone within the development height of the water-conducting fracture zone; and in response to determining the sixth determination result is negative, determining the target grouting control strategy as implementing a curved branch borehole drilling and grouting in the caving zone within the development height of the water-conducting fracture zone.

6. An electronic device, comprising a memory, a processor, and a computer program stored on the memory and executable by the processor, wherein, the processor, when executing the program, implements the method according to claim 1.

* * * * *